US011180893B2

(12) United States Patent
Engert

(10) Patent No.: US 11,180,893 B2
(45) Date of Patent: Nov. 23, 2021

(54) RAIL FASTENING DEVICE

(71) Applicant: GANTRY RAILING LIMITED, Gloucester (GB)

(72) Inventor: Stephen David Engert, Bristol (GB)

(73) Assignee: GANTRY RAILING LTD.

( * ) Notice: Subject to any disclaimer, the term of this patent is extended or adjusted under 35 U.S.C. 154(b) by 362 days.

(21) Appl. No.: 16/310,420

(22) PCT Filed: Jun. 15, 2017

(86) PCT No.: PCT/GB2017/051753
§ 371 (c)(1),
(2) Date: Dec. 14, 2018

(87) PCT Pub. No.: WO2017/216568
PCT Pub. Date: Dec. 21, 2017

(65) Prior Publication Data

US 2019/0218723 A1 Jul. 18, 2019

(30) Foreign Application Priority Data

Jun. 17, 2016 (GB) ..... 1610661
Jul. 22, 2016 (GB) ..... 1612711

(51) Int. Cl.
*E01B 9/66* (2006.01)
*B66C 7/08* (2006.01)
*E01B 9/32* (2006.01)

(52) U.S. Cl.
CPC ..... *E01B 9/66* (2013.01); *B66C 7/08* (2013.01); *E01B 9/32* (2013.01); *E01B 2201/04* (2013.01); *E01B 2204/06* (2013.01)

(58) Field of Classification Search
CPC .... E01B 2201/04; E01B 2204/06; B66C 7/08
See application file for complete search history.

(56) References Cited

U.S. PATENT DOCUMENTS 1,470,090 A * 10/1923 Manning ..... E01B 9/66 238/341
5,344,072 A * 9/1994 Molyneux ..... E01B 9/28 238/331

(Continued)

FOREIGN PATENT DOCUMENTS

CN 1066828 A 12/1992
CN 203403335 U 1/2014

(Continued)

OTHER PUBLICATIONS

European Patent Office, "Communication pursuant to Article 94(3) EPC," in European Patent Application No. 17732183.3, dated Feb. 6, 2020, 5 pages.

(Continued)

*Primary Examiner* — Jason C Smith
(74) *Attorney, Agent, or Firm* — Kang S. Lim

(57) ABSTRACT

A rail fastening device comprises a clip (10) having a base (11) and a nose (12) for engaging a rail flange (F). The base (11) comprises circular aperture (14) in which a circular cam (13) is rotatably mounted, the cam (13) being provided with an eccentric aperture (24) for receiving a ground anchor (25), the cam aperture (24) being radially offset from the rotational centre of the cam (13) to define a cam lobe (15). The cam (13) may comprise a ramped circumferential shoulder (18) to engage a complementary shoulder (21) inside the base aperture (14) such that any rotation of the cam (13) under the applied load of the rail causes the cam (13) to move axially of the base aperture (14) thereby tightening the engagement of the anchor (25) on the cam (13) and preventing movement of the clip (10). The degree of rotation of the cam (13) may be limited so that it can only turn in the tightening direction under load.

6 Claims, 4 Drawing Sheets

(56) References Cited

U.S. PATENT DOCUMENTS

| | | | | |
|---|---|---|---|---|
| 8,439,566 | B2 * | 5/2013 | Connell | F16C 29/12 384/40 |
| 9,103,073 | B2 * | 8/2015 | Vorderbruck | E01B 9/303 |
| 2003/0085294 | A1 * | 5/2003 | Rada | E01B 9/40 238/265 |
| 2006/0011792 | A1 * | 1/2006 | Wirtz | E01B 29/04 248/188.4 |
| 2018/0222726 | A1 * | 8/2018 | Bygrave | E01B 9/46 |
| 2019/0218723 | A1 * | 7/2019 | Engert | E01B 9/66 |
| 2020/0378069 | A1 * | 12/2020 | Lienhard | E01B 7/22 |

FOREIGN PATENT DOCUMENTS

| | | | | |
|---|---|---|---|---|
| DE | 20305292 | | 6/2003 | |
| EP | 0149513 | | 7/1985 | |
| EP | 0855465 | | 7/1998 | |
| EP | 0855465 | A2 * | 7/1998 | E01B 9/66 |
| GB | 867919 | | 5/1961 | |
| GB | 1471868 | | 4/1977 | |
| GB | 2212842 | | 8/1989 | |
| WO | W02015/165790 | | 11/2015 | |
| WO | W0 2017/216568 | | 12/2017 | |

OTHER PUBLICATIONS

European Patent Office, "Communication pursuant to Article 94(3) EPC", in European Application No. 17732183.3, dated May 11, 2020, 5 pages.

The International Bureau of WIPO, "International Preliminary Report on Patentability", in PCT Application No. PCT/GB2017/051753, dated Dec. 27, 2018, 8 pages.

Chinese Patent Office (CNIPA), "Office Action 1", in Chinese Application No. 201780037084.8, dated Jul. 17, 2019, 7 pages.

English summary, Essen Intellectual Capital Management Co., Ltd., pertaining to Chinese Application No. 201780037084.8, Aug. 8, 2019, 5 pages.

Chinese Patent Office (CNIPA), "Office Action 2", in Chinese Application No. 201780037084.8, dated Oct. 21, 2019, 3 pages.

U.K. Intellectual Property Office, GB Application No. GB1612711.0, "Search Report under Section 17", dated Jan. 18, 2017, 1 page.

European Patent Office, "International Search Report and Written Opinion of the International Search Authority," in PCT Application No. PCT/GB2017/051753, dated Aug. 14, 2017, 10 pages.

* cited by examiner

RAIL FASTENING DEVICE

CROSS-REFERENCE TO RELATED APPLICATIONS

The present application is a United States National Stage entry under 35 U.S.C. § 371 of International Application No. PCT/GB2017/051753 filed Jun. 15, 2017, designating the United States of America and published in English on Dec. 21, 2017, which in turn claims priority to Great Britain Application Nos. 1610661.9, filed on Jun. 17, 2016 and 1612711.0, filed on Jul. 22, 2016, all of which are incorporated herein by reference in their entirety.

This invention relates to a device for fastening a rail to the ground or other support structure.

Trains and other apparatus such as cranes run on steel rails which are fastened to the ground or other support structure by a plurality of rail fastening devices arranged at intervals along the length of the rail. The base of a typical rail comprises a pair of oppositely-directed longitudinal flanges and the fastening devices clamp against these flanges to hold the rail in-situ. One known fastening device comprises a clip having a base and a raised nose at one end which engages over the rail flange. A ground anchor bolt extends through a slot in the base. In use, the clip is slid against the rail and the bolt is tightened to hold the clip in-situ.

In some applications, the lateral forces applied to rails can be substantial enough to allow the clip to move relative to the bolt, with the result that the rail could move and cause the risk of a derailment. This can also be a problem in areas where the ground is liable to subsidence. In order to overcome this problem clips have been proposed that can withstand a lateral force much greater than that provided by the bolt used to hold it in-situ. U.S. Pat. No. 1,470,090 and GB1471868 each discloses one such adjustable rail clip comprising a clip having a base and a nose which engages over the rail flange. The base comprises a large circular aperture in which a circular cam is rotatably seated on a circumferential flange. A ground anchor bolt extends through an eccentric aperture in the cam which is radially offset from the rotational centre of the cam. The cam is provided with a formation on its upper face which can be engaged by a spanner or wrench to turn the cam. In use, the clip is slid against the rail and the cam is turned: this causes rotation of the cam relative to the base of the clip about one axis and rotation of the cam relative to the ground anchor bolt about a second axis. The second axis is radially offset from the first axis and thereby causes the clip to be cammed laterally against the rail as the cam is turned through up to 180°, from a position where the lobe of the cam is furthest away from the rail to a position where the lobe of the cam is closest to the rail. Once in-situ, the ground anchor bolt can be tightened to cause the cam to be tightened against the flange in the base aperture so as to prevent rotational movement of the cam and to hold the clip in-situ against the rail.

A problem of this arrangement, is that the forces applied by the rail to the clip can cause rotation of the cam, especially where the frictional resistance between the cam and the body of the clip is reduced by oil or grease in the environment: this problem is especially apparent when the lobe of the cam is between the position where it is furthest away from the rail and a position where it is closest to the rail.

We have now devised an improved rail fastening device of the kind disclosed in U.S. Pat. No. 1,470,090 and GB1471868.

In accordance with the present invention, as seen from a first aspect, there is provided a rail fastening device comprising a clip having a base and a nose for engaging a rail, the base comprising a circular aperture in which a circular cam is rotatably mounted, the cam being provided with an eccentric aperture for receiving a ground anchor, the cam aperture being radially offset from the rotational centre of the cam to define a cam lobe, wherein the cam is seated with the base aperture, such that rotation of the cam causes the cam to move axially of the base aperture.

The cam is seated in the base aperture in such a way that the cam cooperates with the base aperture to cause the cam to move axially of the base aperture as the cam is rotated. In use, the device operates in exactly the same manner as that disclosed in U.S. Pat. No. 1,470,090 and GB1471868. However, the when tightening the clip against the rail, the cam is turned in a direction which causes it to move downwardly inside the base aperture. Once the clip is in-situ, the ground anchor can be tightened to cause the cam to be rotationally locked in position and to hold the clip in-situ against the rail. Any forces applied by the rail to the clip cause rotation of the cam in a direction which causes it to move upwardly inside the base aperture against the ground anchor, thereby tightening the engagement of the anchor on the cam and preventing movement of the clip.

It will be appreciated that the ground anchor could be a threaded shaft extending upwardly from the ground or other surface through the cam and a nut threadably mounted on the shaft for tightening against the upper surface of the cam. Alternatively, the ground anchor could be a bolt extending downwardly through the cam into the ground or other surface, the bolt having a head at its upper for tightening against the upper surface of the cam.

Preferably the cam comprises a ramp or circumferentially extending shoulder which seats on a ramp or shoulder extending around the base aperture, the ramp or shoulders having complementary engaging surfaces which extend helically.

Alternatively, the cam may be threadably engaged with the aperture.

In order to prevent the cam from extending out of the underside of the base and potentially lifting the clip by abutment with ground or other surface, the degree of axial movement of the cam inside the base aperture is preferably constrained, such that a lower end face of the cam is prevented from extending out of the base aperture.

Preferably the degree of rotation of the cam is constrained, preferably over substantially 180° and/or preferably to a point where the lobe of the cam is directed substantially towards the head. In this manner, any force applied to the clip can only cause the cam to rotate in the tightening direction against the ground anchor. This also helps to avoid the problem of human error where the cam is inserted incorrectly.

Also, in accordance with the present invention, as seen from a second aspect, there is provided a rail fastening device comprising a clip having a base and a nose for engaging a rail, the base comprising a circular aperture in which a circular cam is rotatably mounted, the cam being provided with an eccentric aperture for receiving a ground anchor, the cam aperture being radially offset from the rotational centre of the cam to define a cam lobe, wherein the degree of rotation of the cam relative to the base is constrained.

Preferably the degree of rotation of the cam is constrained over substantially 180° and/or preferably to a point where the lobe of the cam is directed substantially towards the head. In this manner, any force applied to the clip can only rotate the cam in one direction and preferably this is configured to be the direction in which the force acting between the ground anchor and the cam increases to resist movement of the clip.

The improvements of the rail fastening device in accordance with the second aspect of the present invention can be applied to rail fastening devices of the kind disclosed in U.S. Pat. No. 1,470,090 and GB1471868. Such devices comprise ground anchors that are tightened by turning a nut or bolt in the clockwise direction, and hence the degree of rotation of the cam is preferably constrained to a sector where, in use, the cam can only move in the clockwise direction when the nose of the clip is displaced towards the ground anchor. In this manner, the friction between the cam and the ground anchor acts to turn the ground anchor in the tightening direction to resist movement of the clip.

An embodiment of the present invention will now be described by way of an example only and with reference to the accompanying drawings, in which.

Figure 1:
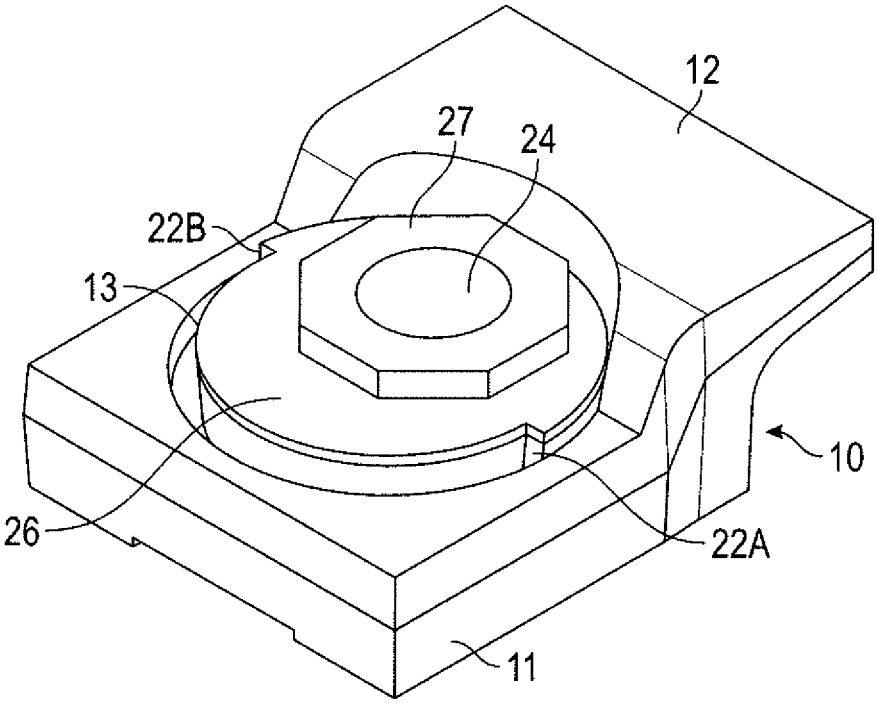
FIG. 1 is an isometric view of a rail fastening device in accordance with the present invention, when in a retracted position.

Referring to the drawings, there is shown a rail fastening device comprising a metal clip 10 having a base 11 and a raised nose 12 provided with an elastomeric member 112 on its underside which engages the flange F of a rail. The rail fastening device further comprises a circular metal cam 13 that is rotatably mounted in a circular aperture 14 formed in the centre of the base 11.

The cam comprises upper and lower end surfaces 15, 16 which face in opposite axial directions and a circumferential side surface 17 which faces radially outwardly. The side surface 17 comprises a radially-extending shoulder 18 at its upper end around the periphery thereof. The underside of the shoulder 18 defines a helically-extending surface 19 which extends axially of the cam 13 from a position P1 to a position P2 which are circumferentially separated by approximately 350°.

The aperture 14 in the base 11 comprises a circumferential side surface which faces radially inwardly and is provides with a radially-extending shoulder 20 at its lower end around the periphery thereof. The upper side of the shoulder 20 defines a complementary helically-extending surface 21 which extends axially and circumferentially of the aperture 14.

The shoulder 18 of the cam comprises a pair of radially extending stop surfaces 22A, 22B which are circumferentially offset from each other by approximately 180° and which face each other around the circumference of the cam 13. The aperture 14 in the base 11 comprises a stop 23 which extends radially inwardly and which is arranged to abut the stop surfaces 22A, 22B in respective rotational positions of the cam 13.

The cam 13 comprises an axially extending eccentric aperture 24 for receiving a ground anchor bolt 25. The cam aperture 24 is radially offset from the rotational centre of the cam to define a cam lobe 26. A hexagonal formation 27 extends around the cam aperture 24 on the upper surface 15 of the cam 13.

In use, the ground anchor 25 is set in the ground or other support surface and the rail fastening device of the present invention is fitted onto the upstanding ground anchor 25 such that it extends through the cam aperture 24. Initially, the rotational position of the cam 13 is such that the lobe 26 thereof is directed away from the nose 12 of the clip 10, as shown in FIG. 1. In this position, the nose 12 is at its furthest distance from the flange F of the rail and hence the clip 10 is relatively loose. A nut 28 and washer are then loosely fitted to the upper end of the upstanding ground anchor 25. At this point the cam 13 is at its most axially raised position. A wrench or spanner is then engaged with hexagonal formation 27 and used to turn the cam 13 in the clockwise direction (when the cam 13 is viewed from above) from the position shown in FIG. 1 towards the position shown in FIG. 2. The cam 13 is displaced axially towards the ground as it is turned by virtue of the complementary helical engagement surfaces 19, 21 on the cam 13 and base 11. The rotational movement of the cam 13 causes the clip 10 to slide towards the rail flange F by virtue of the eccentric cam aperture 24. A very high locking force of the clip 10 against the rail flange F can be achieved even by applying a relatively modest turning force to the cam 13.

Once the clip 10 is in the desired position against the rail flange F, the nut 28 of the ground anchor bolt can be tightened against the upper surface 15 of the cam 13 to rotationally lock the cam 13 in position and to hold the clip 10 in-situ against the rail flange F.

Figure 2:
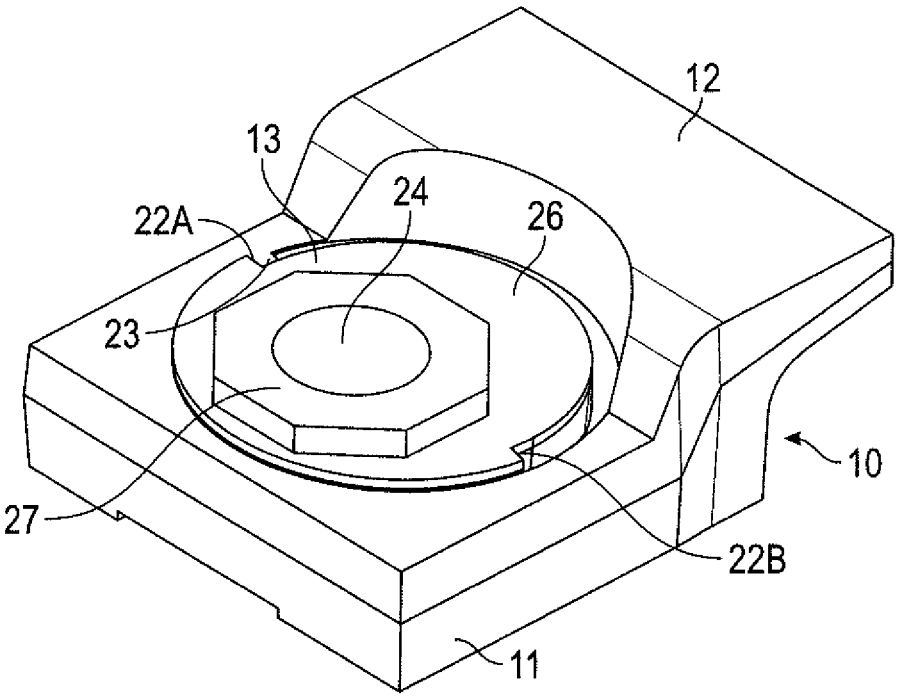
FIG. 2 is an isometric view of the rail fastening device of FIG. 1, when in an extended position.
Figure 3:
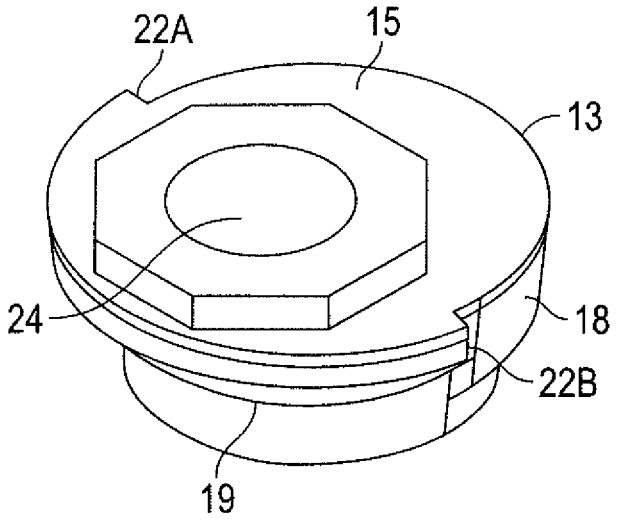
FIG. 3 is an exploded isometric view of the rail fastening device of FIG. 1.
Figure 3:
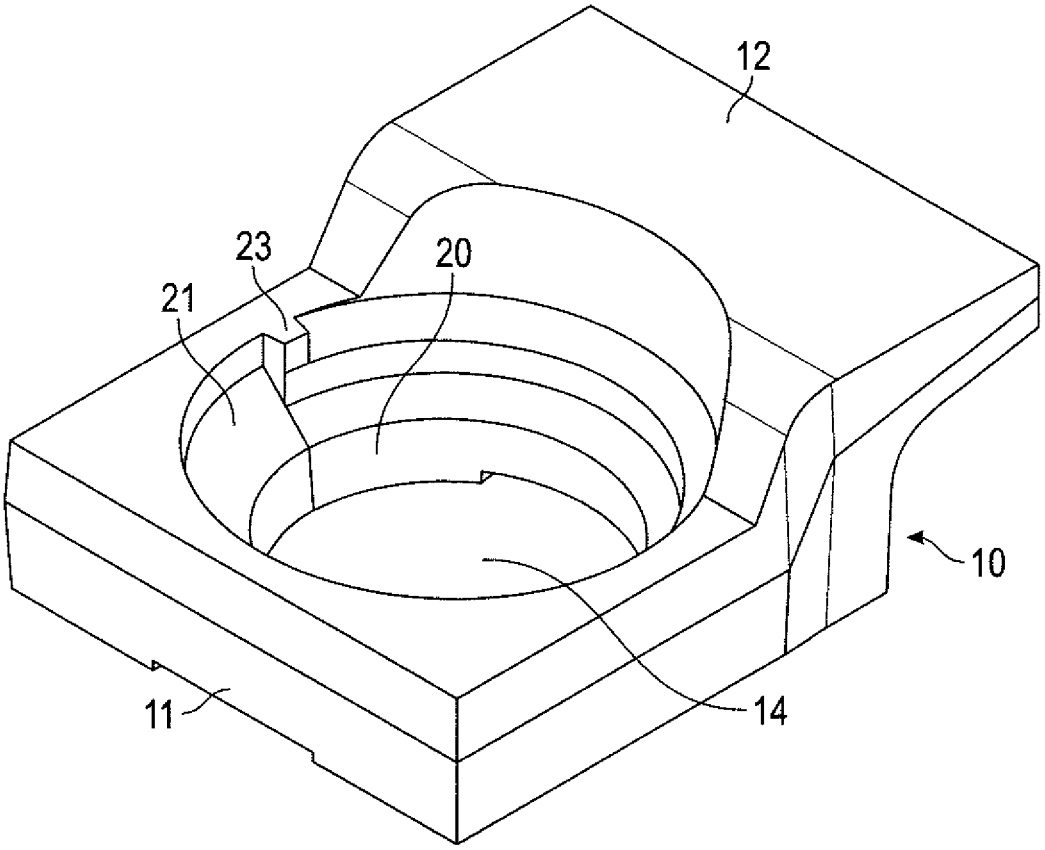
Figure 4:
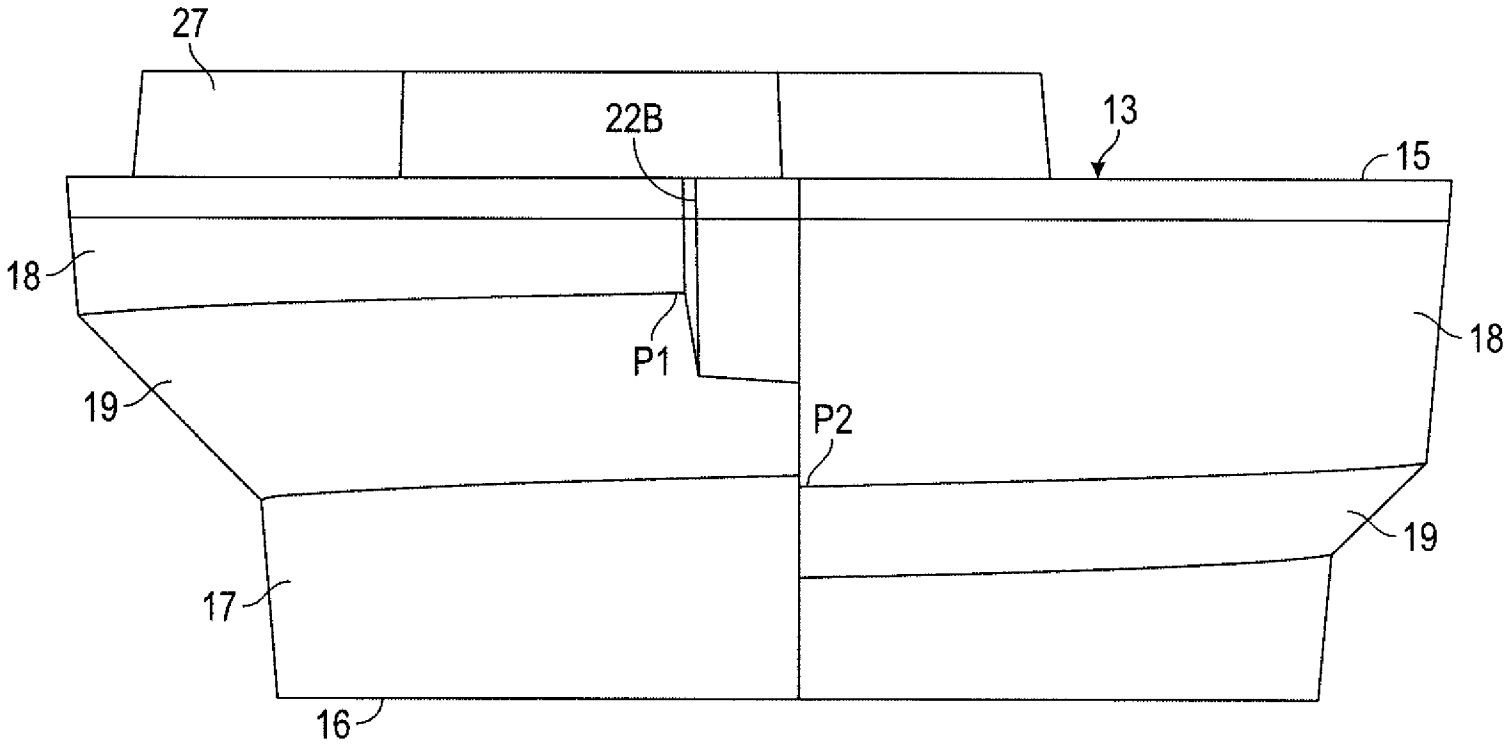
FIG. 4 is a side view of a cam of the rail fastening device of FIG. 1.
Figure 5:
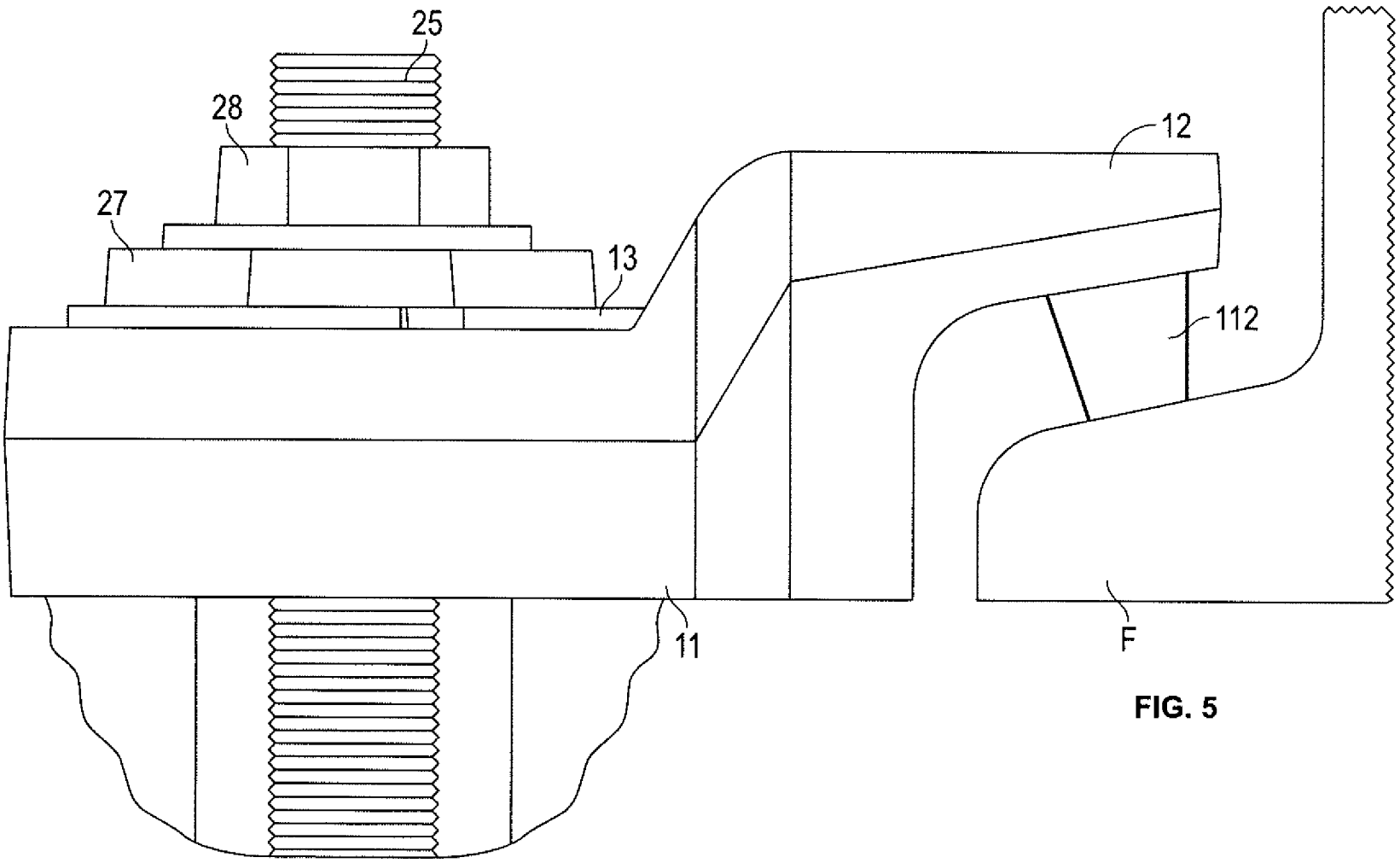
FIG. 5 is a side view of the rail fastening device of FIG. 1, when in use.

The degree of rotation of the cam 13 is constrained, by the interaction of the stop surfaces 22A, 22B with the stop 23, to substantially 180° between the position of FIG. 1 (where the lobe 26 of the cam 13 is directed directly away from the nose 12) and the position of FIG. 2 (where the lobe 26 of the cam 13 is directed directly towards the nose 12). In this manner, any force applied to the clip 10 by movement of the rail can only cause the cam 13 to rotate in the counter clockwise direction and hence axially upwardly against the nut 28 of the ground anchor 25. This tightens the engagement of the nut 28 on the cam 13 and prevents movement of the clip 10.

A rail fastening device in accordance with the present invention is simple in construction yet is able to resist very substantial forces that might be applied by the rail.

The invention claimed is:

1. A rail fastening device comprising a clip having a base and a nose for engaging a rail, the base comprising a circular aperture in which a circular cam is rotatably mounted, the cam being provided with an eccentric aperture for receiving a ground anchor, the cam aperture being radially offset from the rotational centre of the cam to define a cam lobe, wherein the cam is seated in the base aperture, in such a way that the cam cooperates with the base aperture to cause the cam to move axially of the base aperture as the cam is rotated.

2. A rail fastening device as claimed in claim 1, in which the degree of rotation of the cam is constrained.

3. A rail fastening device as claimed in claim 2, in which the degree of rotation of the cam is constrained to 180° or less.

4. A rail fastening device as claimed in claim 2, in which the degree of rotation of the cam is constrained to a point where the lobe of the cam is directed substantially towards the head.

5. A rail fastening device as claimed in claim 1, in which, in use, the cam only rotates in a direction which moves it axially towards a head or bolt of the ground anchor when the nose of the clip is displaced towards the ground anchor.

6. A rail fastening device as claimed in claim 5, in which the direction is a clockwise direction.

* * * * *